US009512956B2

(12) United States Patent
Machande et al.

(10) Patent No.: US 9,512,956 B2
(45) Date of Patent: Dec. 6, 2016

(54) APPLIANCE SHIPPING RUNNER

(71) Applicants: Joshua Machande, Miles, IA (US); Ronald A. Zimmer, Dewitt, IA (US)

(72) Inventors: Joshua Machande, Miles, IA (US); Ronald A. Zimmer, Dewitt, IA (US)

(73) Assignee: Custom-Pak, Inc., Clinton, IA (US)

( * ) Notice: Subject to any disclaimer, the term of this patent is extended or adjusted under 35 U.S.C. 154(b) by 0 days.

(21) Appl. No.: 14/643,482

(22) Filed: Mar. 10, 2015

(65) Prior Publication Data

US 2016/0265711 A1 Sep. 15, 2016

(51) Int. Cl.

| | |
|---|---|
| ***F16M 11/00*** | (2006.01) |
| ***F16M 11/22*** | (2006.01) |
| ***B65D 85/66*** | (2006.01) |
| *B65D 85/20* | (2006.01) |
| *B65D 71/70* | (2006.01) |

(52) U.S. Cl.

CPC ..... *F16M 11/22* (2013.01); *B65D 85/66* (2013.01); *B65D 71/70* (2013.01); *B65D 85/20* (2013.01); *F16M 2200/08* (2013.01)

(58) Field of Classification Search

CPC ..... F16M 11/22; F16M 2200/08; B65D 85/66; B65D 85/20; B65D 19/00; B65D 71/70

USPC ..... 248/188.9, 346.01, 188.1; 206/391, 443

See application file for complete search history.

(56) References Cited

U.S. PATENT DOCUMENTS

| | | | | |
|---|---|---|---|---|
| 3,951,078 | A * | 4/1976 | Fowler | B65D 19/0018 108/57.28 |
| 5,899,331 | A * | 5/1999 | Warren, Jr. | B65D 71/70 206/389 |
| 5,934,467 | A * | 8/1999 | Gilfert | B65D 85/66 206/391 |
| 7,044,358 | B2 * | 5/2006 | Gratz | B65D 85/66 206/394 |
| 7,434,777 | B2 * | 10/2008 | Swannell | B65D 71/70 206/391 |
| 8,807,492 | B2 * | 8/2014 | Lake | F16L 3/222 248/65 |
| 2002/0063194 | A1 * | 5/2002 | O'malley | B65D 19/44 248/346.02 |

OTHER PUBLICATIONS

Runner Sample Images, Oct. 18, 2014, 1 page.

* cited by examiner

*Primary Examiner* — Anita M King
(74) *Attorney, Agent, or Firm* — St Onge Steward Johston and Reens LLC

(57) ABSTRACT

A blow molded runner having a bottom wall and a top wall forming a double wall blow molded configuration, at least one compressed double wall structure defined by compression of the bottom and top walls against each other such that an inner surface of the bottom wall is in contact with an inner surface of the top wall. At least two columns spaced apart at a distance wherein each of the at least two columns defines one of the at least one compressed double wall structure and has a top surface and the compressed double wall structure corresponding to each of the at least two columns extends from the top surface to a bottom surface of the runner at the at least two columns wherein the bottom surface is defined by an outer surface of the bottom wall.

25 Claims, 7 Drawing Sheets

APPLIANCE SHIPPING RUNNER

FIELD OF THE INVENTION

This invention relates to items used in packaging, shipping and warehousing large, bulky items. More particularly, the invention relates to runners that are affixed to the bottom of appliances for warehousing, packaging and shipping purposes.

BACKGROUND OF THE INVENTION

Runners are commonly used when warehousing, shipping and packaging large, bulky items such as appliances. Due to the weight and/or size of these items, they can be difficult to move. In warehousing situations, the ability to slide these items into and out of packaging is desired to aid both in packing and un-packing of the bulky item. The advantages in unpacking are further provided in that installation is aided due to the ability of the runner to easily slide along a floor and make it easier to move the bulky item closer to the installation position.

Runners mounted to the bottom of appliances also provide protection to the corners and edges of the appliance in that the runners extend beyond the bottom perimeter of the appliance and provide a bumper that prevents the corners from becoming dented and scratched during packaging, shipping and warehousing.

Many runners currently available are made with blow molding, which provides an inexpensive way of manufacturing a plastic runner without the material costs of injection molding a solid runner. The difficulty with currently available blow molded runners is that stiffness of the runner is often inadequate in the warehousing scenario when multiple bulky items, such as dishwashers are stacked on top of each other. The weight of the stack of bulky items is concentrated on the runners, which are often made of primarily a double walled configuration.

Although double walled configurations add bending stiffness over longer lengths, the thickness and/or configuration of the walls may provide insufficient localized stiffness. The bulky item is often positioned on the runner at specific points, which results in point like loads or loads that are distributed over a relatively small portion of the runner.

In this case, the prior art double wall configuration of the mounting areas allows for the mounting areas to buckle under load despite the fact that the overall bending stiffness of the runner is sufficient for supporting the overall weight of the bulky item. In addition, the cross section may have a tendency to deform or bend away from the axis of the force. See FIG. 9 for an example showing one possible localized deflection of a runner (movement from A to B).

The buckling and deformation problems around the mounting areas can create a situation in which the entire stack can shift and if the buckling is too much, there is the possibility that an appliance becomes damaged. For example, imagine the stack shown in FIG. 2 used the runner of FIG. 9 instead of the improved runner disclosed herein.

Therefore, it is desired to provide an improved runner for bulky and heavy items such as appliances so that the runner has both increased localized stiffness at the attachment points for the appliance and sufficient overall stiffness to resist deflection under load.

SUMMARY OF THE INVENTION

It is therefore an object of the invention to provide a runner having attachment points with increased stiffness.

It is yet another object of the invention to provide increased localized stiffness while still providing sufficient overall stiffness for the runner.

It is yet another object of the invention to provide a runner that deflects less under load and reduces the possibility of tipping in a stack of bulky items or appliances.

The terms "first" and "second" are used to distinguish one element, set, data, object or thing from another, and are not used to designate relative position or arrangement in time.

These and other objects are achieved by providing a blow molded runner adapted to attach to a bottom of an item including a bottom wall and a top wall forming a double wall blow molded configuration. At least one compressed double wall structure may be defined by compression of the bottom and top walls against each other such that an inner surface of the bottom wall is in contact with an inner surface of the top wall. At least two columns may be spaced apart at a distance wherein each of the at least two columns defines one of said at least one compressed double wall structure and has a top surface and said compressed double wall structure corresponding to each of said at least two columns extends from the top surface to a bottom surface of the runner at the at least two columns wherein the bottom surface is defined by an outer surface of said bottom wall.

The runner may include a channel extending from a first to a second one of said at least two columns said channel at least as long as the distance wherein at least part of said channel defines another one of said at least one compressed double wall structures. At least one of the at least two columns may include a top surface and tapered sides, the tapered sides extending outwardly in a downward direction. The inner surface of the bottom wall and the inner surface of the top wall may be fused together at the at least one compressed double wall structure. A groove may be defined in at least one of the at least two columns and may extend from the top surface towards said bottom surface.

Two double wall sections may be disposed on either side of the at least two columns such that the top surface protrudes above a second top surface of the two double wall sections. A plurality of protrusions may extend from the bottom wall to provide reduced friction between the bottom wall and a floor. A channel may extend from the bottom wall towards the top wall and may further extend between the at least two columns such that a portion of the at least one compressed double wall structure adjacent to one of the columns is disposed between the channel and the one of the columns.

A cross rib may be disposed perpendicular to an axis defined between the at least two columns, the cross rib defining a passage between first and second sides of the runner wherein the top and bottom walls of the first and second sides are disposed apart from each other to define a void in fluid communication with the passage wherein at least one of the at least one compressed double wall structure is disposed on either side of the cross rib. A rib may be disposed along a lengthwise axis of the runner and positioned between the at least two columns and a portion of the rib may be configured as a double wall structure. The rib may include another one of the at least one compressed double wall structures on either side of the portion of the rib.

In other aspects a blow molded runner is provided and adapted to attach to a bottom of an item. The blow molded runner may include a bottom wall and a top wall forming a double wall blow molded configuration. At least one compressed double wall structure may be defined by compression of the bottom and top walls against each other. At least two columns may be spaced apart at a distance wherein each of the at least two columns defines one of the at least one compressed double wall structures. Two channels may be positioned on either side of a first to a second one of the at least two columns and may extend between the first and second one of said at least two columns, the channel at least as long as the distance wherein at least part of the channel defines another one of the at least one compressed double wall structures. The item may be adapted to connect to the at least two columns.

A rib may be disposed along a lengthwise axis of the runner and positioned between the at least two columns and a portion of the rib may be configured as a double wall structure. The rib may include another one of the at least one compressed double wall structures on either side of the portion of the rib. At least one of the at least two columns may define a top surface and the compressed double wall structure corresponding to the at least one of the at least two columns may extend from the top surface to a bottom surface of the runner wherein the bottom surface is defined by an outer surface of the bottom wall. At least one of the at least two columns may include a top surface and tapered sides, the tapered sides extending outwardly in a downward direction. The inner surface of the bottom wall and the inner surface of the top wall may be fused together at the at least one compressed double wall structure.

A groove may be defined in at least one of the at least two columns and may extend from the top surface towards said bottom surface. Two double wall sections may be disposed on either side of the at least two columns such that the top surface protrudes above a second top surface of the two double wall sections. A plurality of protrusions may extend from the bottom wall, the plurality of protrusions reducing a friction between said bottom wall and a floor for easy movement of the item.

A channel may extend from the bottom wall towards the top wall and may further extend between the at least two columns such that a portion of the at least one compressed double wall structure adjacent to one of the columns is disposed between the channel and the one of the columns.

Yet other objects are achieved by providing a blow molded runner adapted to attach to a bottom of an item, the blow molded runner including at least two supports each having a top, said at least two supports spaced apart at a distance and each one of the two supports adapted to contact the item such that at least part of a weight of the item is supported by said at least two supports, and a compressed double wall structure extending continuously from a base of each of said at least two supports located at a bottom of the blow molded runner to the top of each of said at least two supports.

In one aspect the two supports each define a perimeter, the compressed double wall structure extending around at least 50% of the perimeter of at least one of the two supports. In other aspects the compressed double wall structure extends around at least 75% of the perimeter of the at least one of the two supports.

Other objects of the invention and its particular features and advantages will become more apparent from consideration of the following drawings and accompanying detailed description.

DETAILED DESCRIPTION OF THE INVENTION

Figure 1:
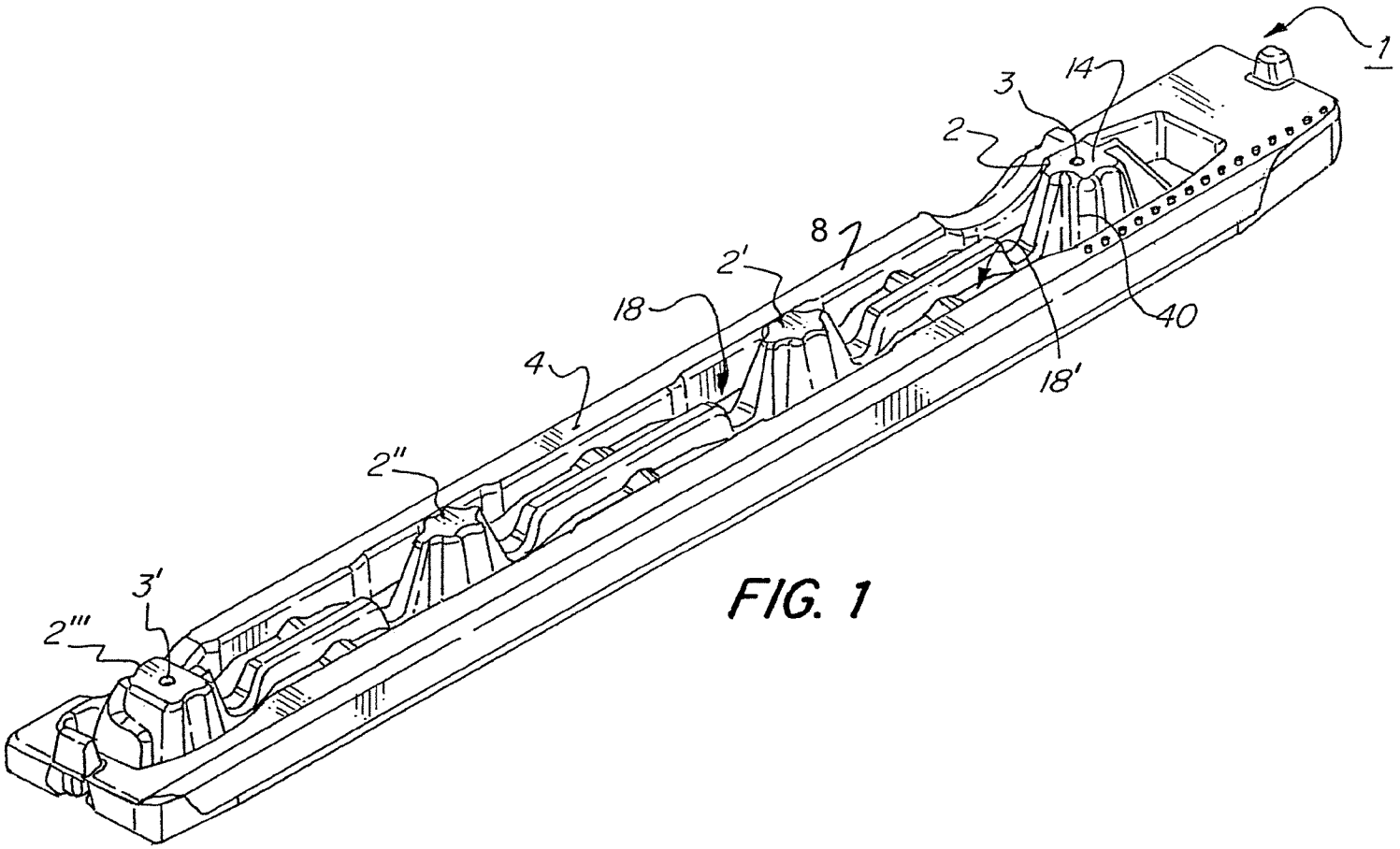
FIG. 1 is a perspective view of a runner according to the present invention.
Figure 2:
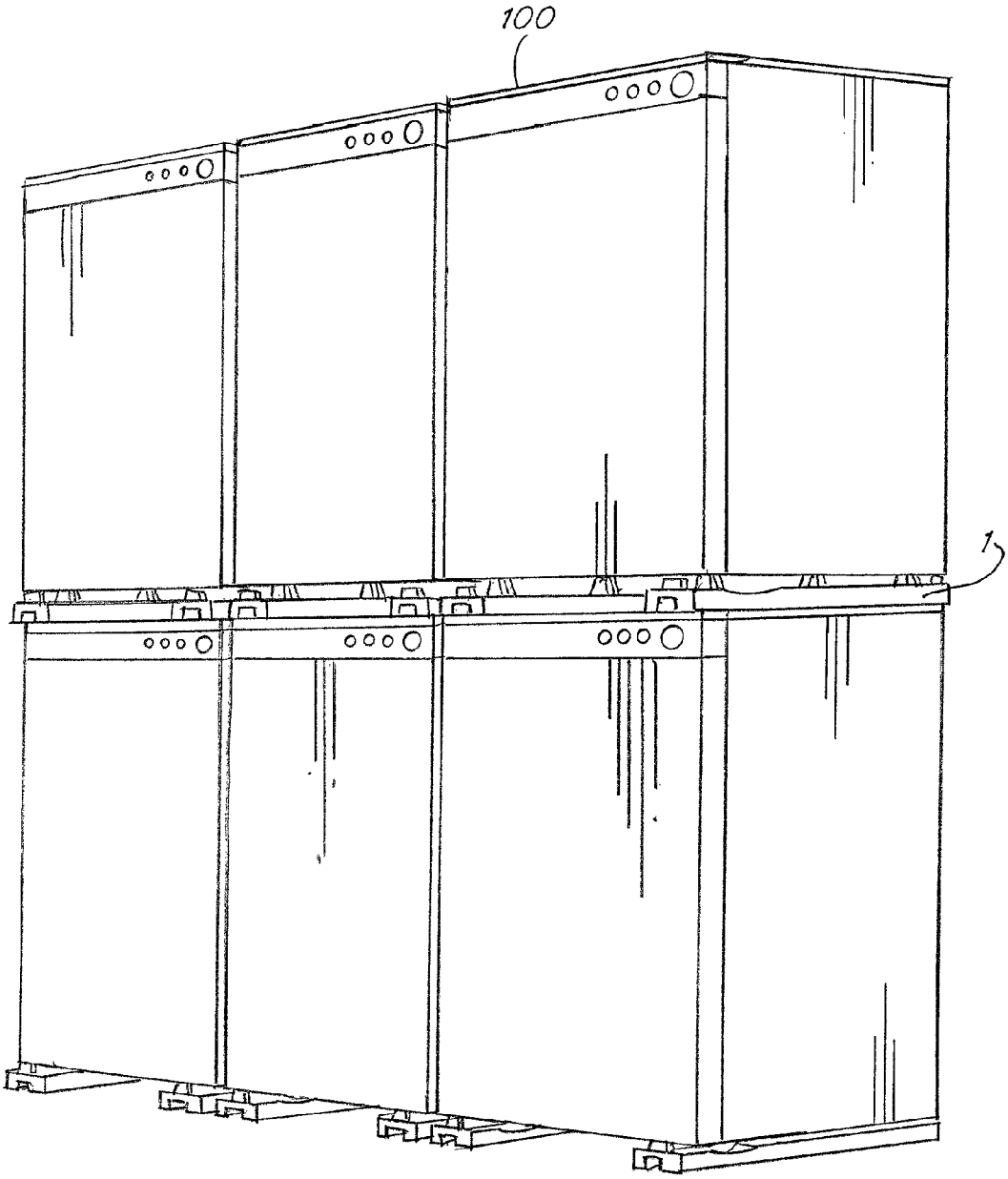
FIG. 2 is perspective view of the runner of FIG. 1 installed on appliances in a warehouse.
Figure 3:
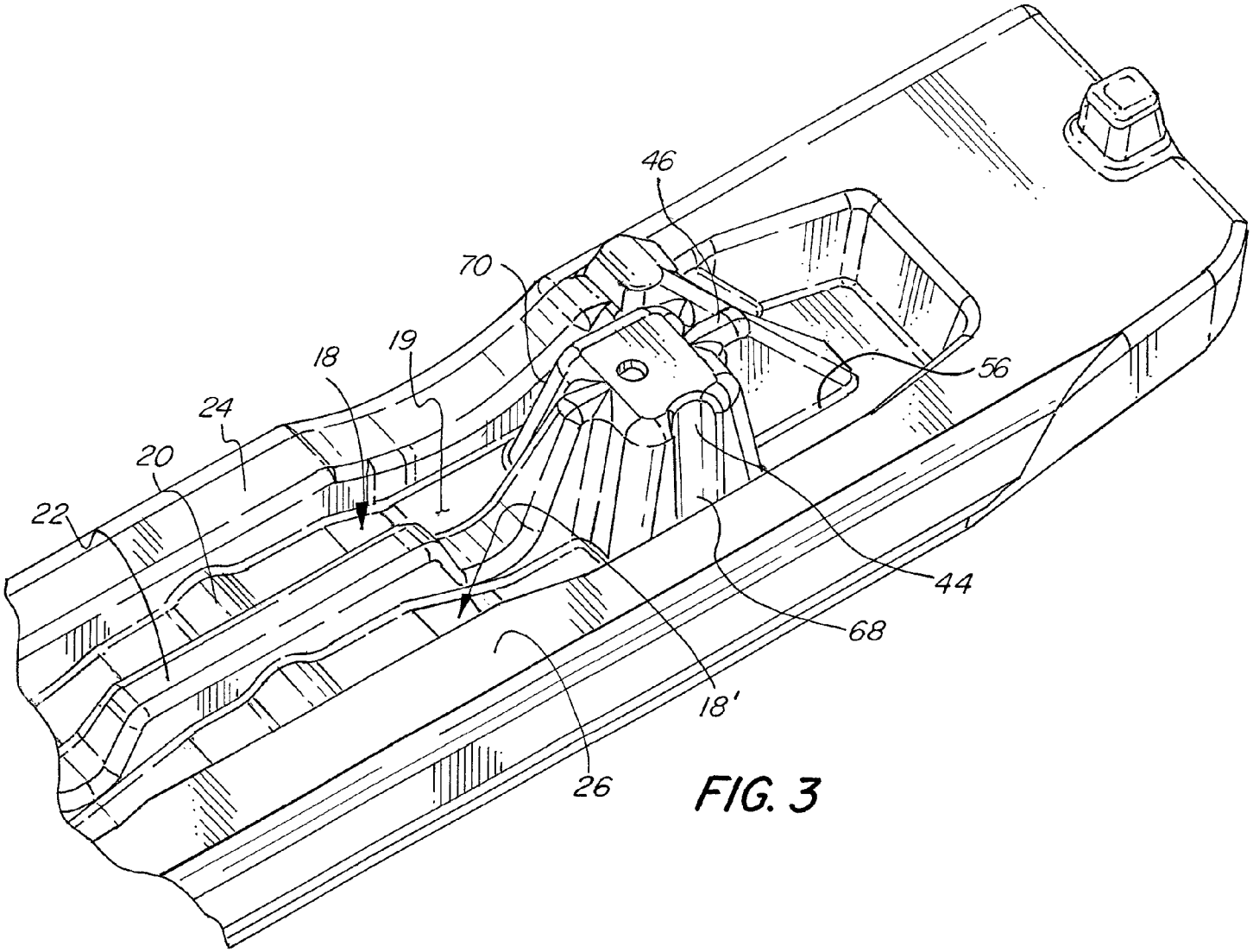
FIG. 3 is a top detail perspective view of the runner of FIG. 1.
Figure 4:
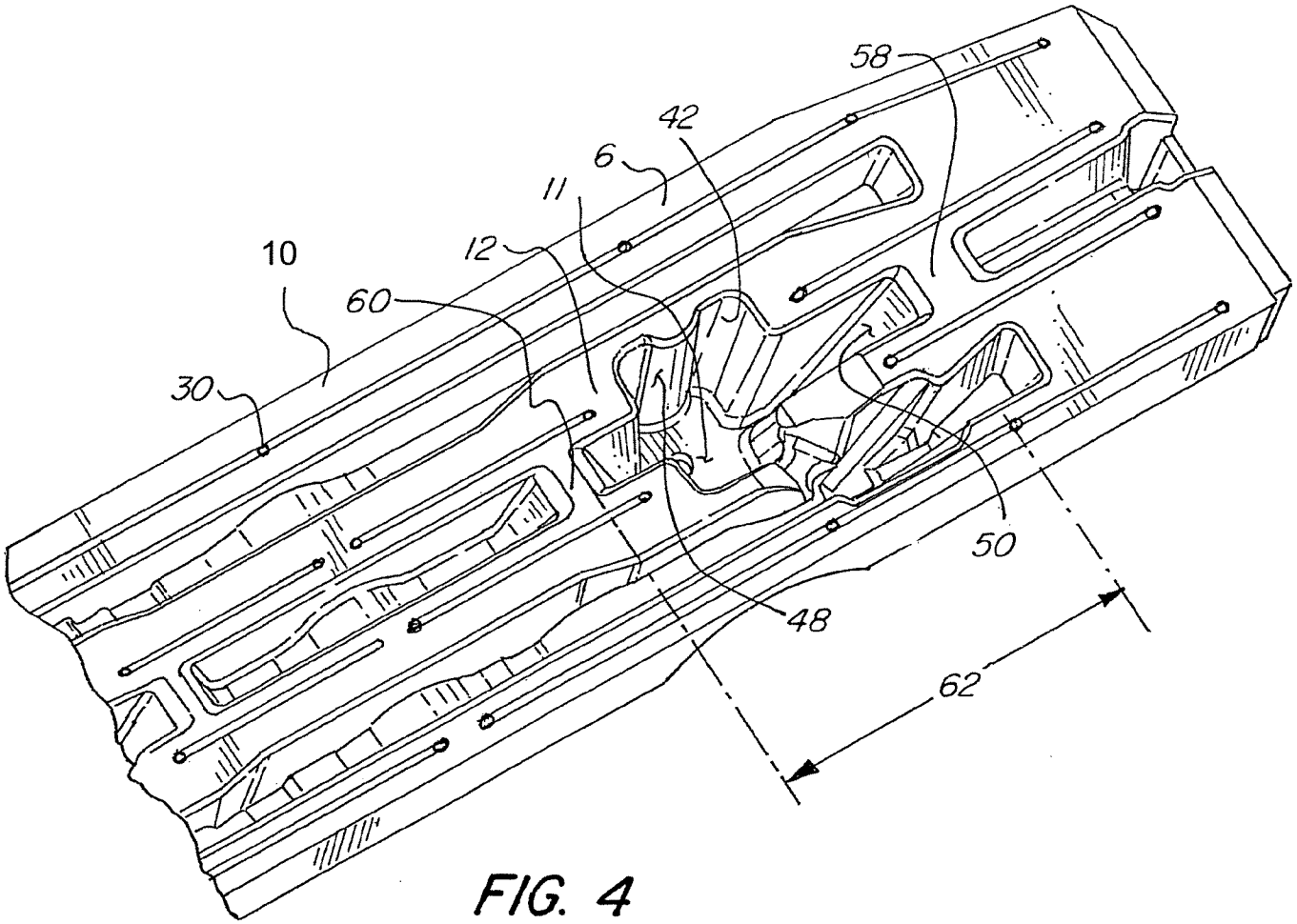
FIG. 4 is a bottom detail perspective view of the runner of FIG. 1.
Figure 5:
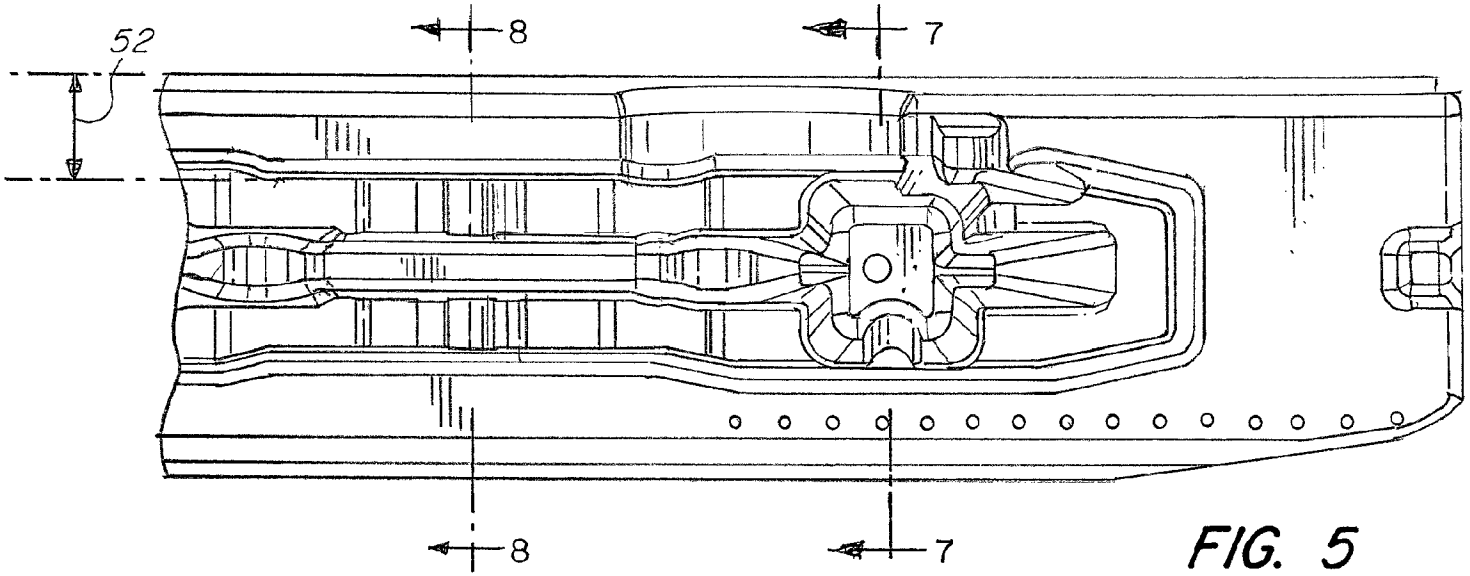
FIG. 5 is a top detail view of the runner of FIG. 1.
Figure 6:
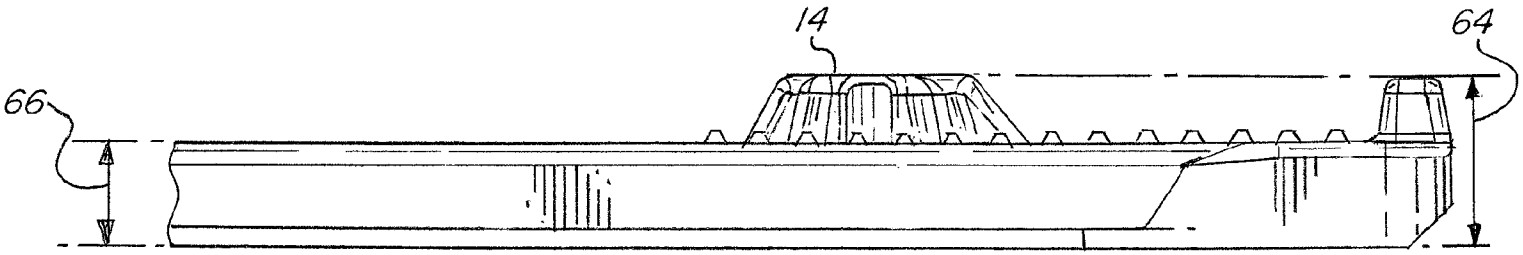
FIG. 6 is a side detail view of the runner of FIG. 1.

Referring now to the drawings, wherein like reference numerals designate corresponding structure throughout the views, the following examples are presented to further illustrate and explain the present invention and should not be taken as limiting in any regard. In FIG. 2, an example stack of appliances 100 is shown with runners 1 mounted to the bottom of the appliances 100. The runners 1 allow the appliances 100 to be slid along the floor of the warehouse or into packaging. On the bottom of the runners 1 there may be protrusions 30 which may reduce friction between the runner 1 and the surface the runner sits.

In FIGS. 1 and 3-8, the runner 1 is shown with four columns 2, 2', 2", 2'". The outer columns 2 and 2'" are shown with holes 3, 3' therein. The holes can receive bolts or other types of securing structures to secure the runner 1 to an appliance or other item. The runner 1 includes a top wall 4 with a top surface 8 and a bottom wall 6 and a bottom surface 10. The runner may be manufactured through blow molding and thus the top and bottom walls may initially be part of one parison which is heated and then expanded within the mold.

Figure 7:
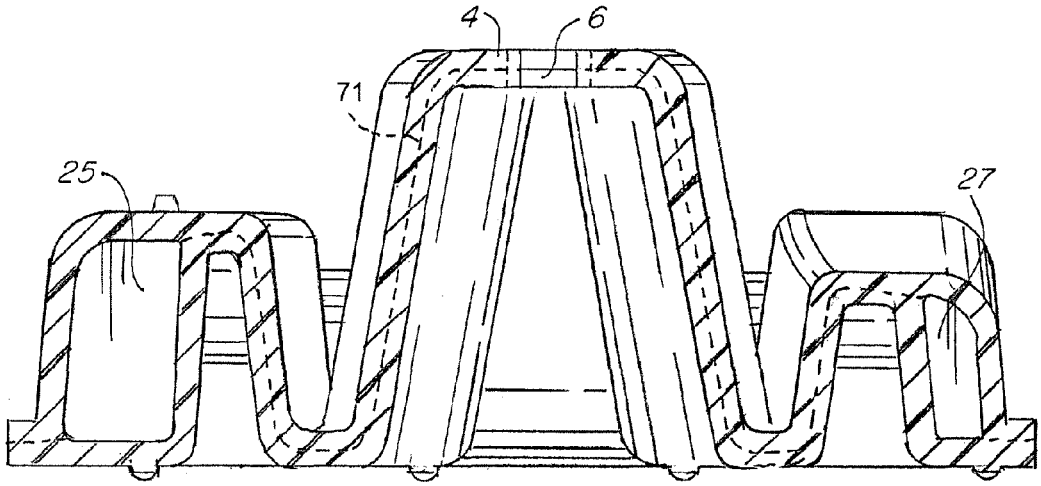
FIG. 7 is a cross section view of the runner of FIG. 1 along section line 7-7 shown in FIG. 6.

During molding the top 4 and bottom 6 walls may be joined or fused together in some locations on the runner 1 due to the temperature of the parison and pressure between the mold halves. This joining of two walls may form what is referred to as a compressed double wall structure in that inner surfaces of the top and bottom walls are in contact and may be fused together during molding. See FIG. 7 showing an example of line 70 which shows where fusion between the walls may occur.

In some locations along the runner, the top and bottom walls may remain separated to form an internal void which may be referred to as a double wall structure.

One example of a compressed double wall structure is shown with respect to the columns, for example column 2 has a top section with a top surface 14 and a bottom surface 11. The top surface is part of the top wall and the bottom surface is part of the bottom wall and the inner surfaces of the top and bottom wall in this location are joined together to form a compressed double wall structure. The compressed double wall structure extends along the sides of the column such that outside surface 40 and inside surface 42 are respectively part of the top 4 and bottom 6 walls and are joined at their inner surfaces. As can be seen the compressed double wall structure extends from the top surface 14 of the column towards the bottom surface 12 of the runner 1. Because this compressed double wall structure extends from the top surface 14 where the appliance or other item attaches and extends down to the bottom surface 12 of the runner, the possibility that buckling occurs between the top 4 and bottom 6 walls in a localized manner at the columns is reduced. The outer side of the column 2 also has series of inwardly directed grooves 44 and outwardly directed protrusions 46. These grooves 44 and protrusions 46 correspond to inside protrusions 48 and inside grooves 50. These grooves 44/50 and protrusions 46/48 provide additional buckling stiffness that resists the tendency of the compressed double wall structure to buckle due to the compression load from the weight of the appliance or item mounted to the runner 1.

Along the lengthwise direction of the runner 1, sides 24/26 are located on either side of the columns and are in a double wall configuration. These sides 24/26 provide increased rigidity in bending over the lengthwise direction of the runner 1. Extending between the columns and adjacent to the sides 24/26 are channels 18/18'. These channels may have both compressed double wall sections 19 and a cross rib 20 defines a double wall section. Between channels 18/18' is a rib 22 that is a double wall section. During molding, it may be necessary for fluid pressure such as air to be directed into the cavity formed by the rib 22 and its double wall configuration. The cross rib 20 defines a passage 23 that allows fluid communication with the space 25/27 inside the sides 24/26.

When a bending load is imposed on the runner 1, the combination of the sides 24/26, channels 18/18' and rib 22 may provide increased rigidity in comparison to structure that is only double wall, for example with a rectangular cross section. Although a rectangular cross section may be stiffer in pure bending, it is possible that the cross section may collapse due to localized buckling which would cause pure bending not to exist in real world applications of the runner 1. Here, the thickness 52 of the sides 24/26 is approximately the same as the height 66. In other embodiments the thickness 52 may be up to twice as much as the height 66. However, in some applications, the overall bending stiffness of the runner 1 may be less important that the localized stiffness of the runner 1 at the column 2.

Figure 9:
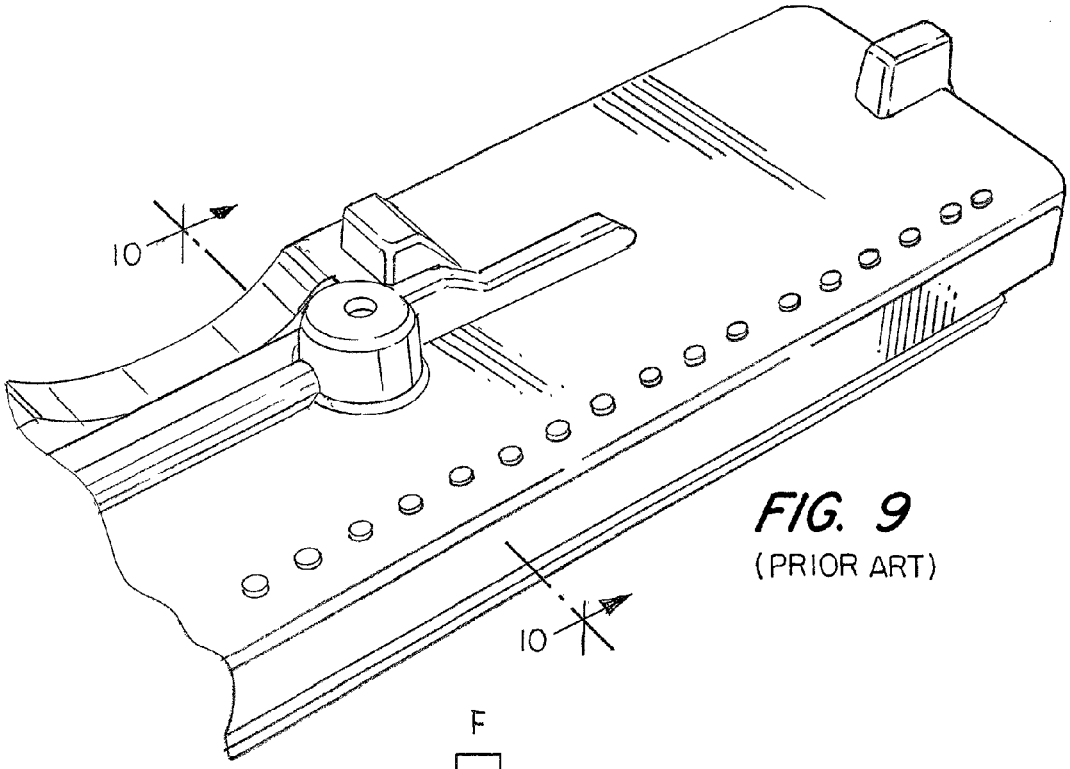
FIG. 9 (PRIOR ART)
FIG. 9 is a perspective detail view of a prior art runner.

As a comparison, consider the prior art runner shown in FIG. 9. This runner includes a double wall structure (walls 1000, 1001 and walls 1000' and 1001') in the column. Therefore, when a compressive load (F) is placed on top surface 1002, the walls of the column can compress towards or away from each other. Further, there are no channels on either side of the column.

Figure 10:
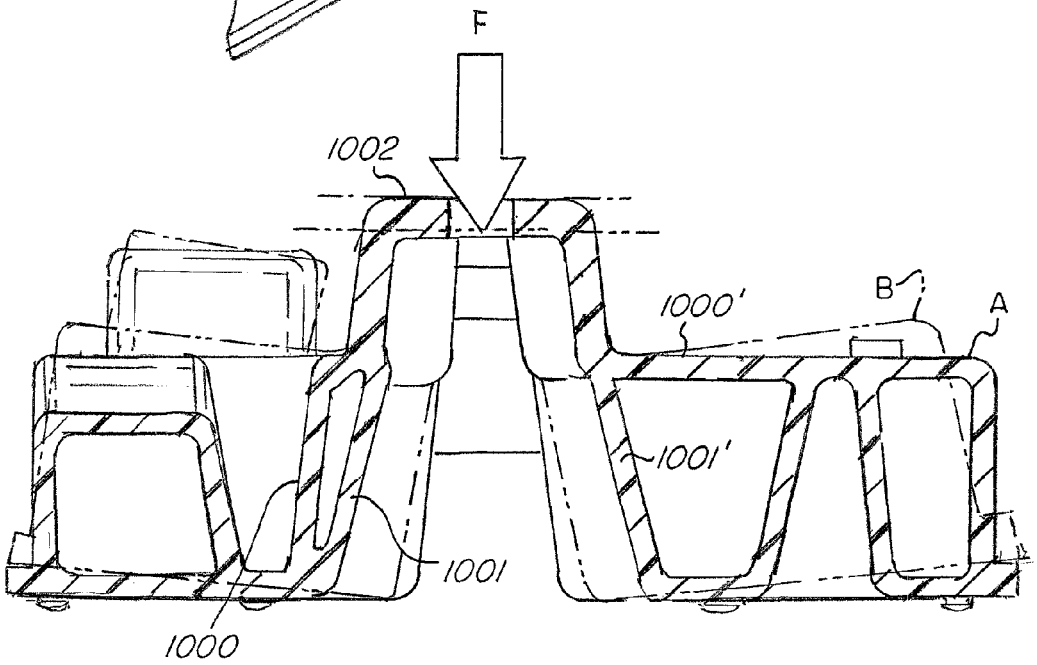
FIG. 10 (PRIOR ART)
FIG. 10 is a cross section view of the prior art runner of FIG. 9 along section line 10-10.

The channels on either side of Applicant's column are located relatively are located at the bottom 56 of the column which provides support across the runner 1 to prevent or at least reduce the flexing action flexing action (movement from A to B) shown in FIG. 10. Further, in bending, although the cross section shown in FIG. 9 may be of a more square configuration than the runner shown in FIGS. 1-8, localized buckling and the flexing action in the prior art runner reduces the local stiffness and can cause the a stack of appliances to tilt.

Consider compressed double wall sections 60/58 which are located at the bottom 56 of the column. Because the distance 62 is relatively small in comparison to the height 64, the possibility of sides 68 and 70 moving away from each other (similar to the flexing action of FIG. 9.) is reduced or eliminated. In one embodiment, the distance 62 is may be less than four, three or two times the height 64. The compressed double wall sections 60/58 provide tensile resistance to deformation across the width of the runner 1 when a load is placed on the column 2. The bottom of the column may further define a perimeter around the base of the column, and the compressed double wall sections may extend around 50% or more of the perimeter. In some examples, the compressed double wall sections may extend around 75% or substantially all of the perimeter.

Referring to FIG. 7, the dashed line 71 shows approximately where the top 4 and bottom 6 walls are fused together during molding. As can be seen, the compressed double wall section extends along the dashed line 71 and terminates at spaces 25/27 where a double wall section is formed and the top and bottom walls are separated. In some embodiments the compressed double wall section may have a thickness twice as much as the individual wall thicknesses of the double wall sections. In other embodiments, the mold halves may be separated less than twice the individual wall thicknesses to cause the plastic to squeeze toward the double wall sections .It is understood that the dashed line 71 represents one example of how the top 4 and bottom 6 walls fuse together, however, the molten nature of the plastic may cause this fusion line to be wavy or not perfectly centered between the thickness of the compressed double wall structure.

Figure 8:
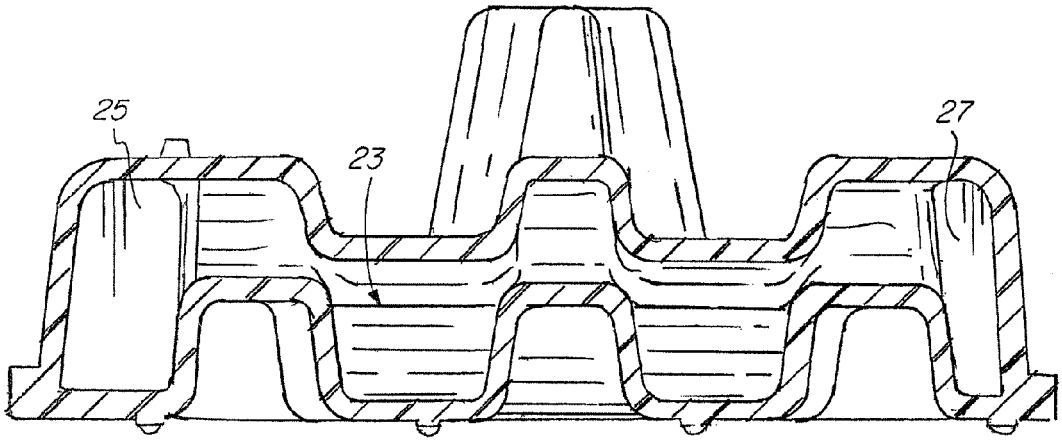
FIG. 8 is a cross section view of the runner of FIG. 1 along section line 8-8 shown in FIG. 6.

In FIG. 8, the passage 23 allows for fluid communication between spaces 25 and 27, which may be necessary to allow for fluid pressure introduced inside the parison to reach all necessary parts of the runner in order to control where compressed double wall structures exist and where double wall structures exist. In one example, the fluid pressure may simply be due to compressed air, however other fluids are contemplated.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A blow molded runner adapted to attach to a bottom of an item, comprising:

a bottom wall and a top wall forming a double wall blow molded configuration;

at least one compressed double wall structure defined by compression of said bottom and top walls against each other such that an inner surface of the bottom wall is in contact with an inner surface of the top wall;

at least two columns spaced apart at a distance wherein each of said at least two columns defines one of said at least one compressed double wall structure and has a top surface and said compressed double wall structure corresponding to each of said at least two columns extends from the top surface to a bottom surface of the runner at the at least two columns wherein the bottom surface is defined by an outer surface of said bottom wall;

wherein the inner surface of the bottom wall and the inner surface of the top wall are fused together at the at least one compressed double wall structure.

2. The runner of claim 1 further comprising a channel extending from a first to a second one of said at least two columns said channel at least as long as the distance wherein at least part of said channel defines another one of said at least one compressed double wall structures.

3. The runner of claim 1 wherein at least one of the at least two columns includes a top surface and tapered sides, the tapered sides extending outwardly in a downward direction.

4. The runner of claim 1 further comprising:

a groove defined in at least one of the at least two columns and extending from the top surface towards said bottom surface.

5. The runner of claim 1 further comprising two double wall sections disposed on either side of the at least two columns such that said top surface protrudes above a second top surface of the two double wall sections.

6. The runner of claim 1 further comprising:

a plurality of protrusions extending from said bottom wall to provide reduced friction between said bottom wall and a floor.

7. The runner of claim 1 further comprising:

a channel extending from said bottom wall towards said top wall and extending between said at least two columns such that a portion of said at least one compressed double wall structure adjacent to one of the columns is disposed between said channel and the one of the columns.

8. The runner of claim 1 further comprising:

a cross rib disposed perpendicular to an axis defined between said at least two columns said cross rib defining a passage between first and second sides of the runner wherein the top and bottom walls of the first and second sides are disposed apart from each other to define a void in fluid communication with the passage wherein at least one of said at least one compressed double wall structure is disposed on either side of said cross rib.

9. The runner of claim 1 further comprising:

a rib disposed along a lengthwise axis of the runner and positioned between the at least two columns;

a portion of said rib configured as a double wall structure.

10. The runner of claim 9 further comprising:

said rib including another one of said at least one compressed double wall structures on either side of the portion of said rib.

11. A blow molded runner adapted to attach to a bottom of an item, comprising:

a bottom wall and a top wall forming a double wall blow molded configuration;

at least one compressed double wall structure defined by compression of said bottom and top walls against each other;

at least two columns spaced apart at a distance wherein each of said at least two columns defines one of said at least one compressed double wall structures;

two channels positioned on either side of a first and a second one of said at least two columns and extending between said first and second ones of said at least two columns, said channel at least as long as the distance wherein at least part of said channel defines another one of said at least one compressed double wall structures;

wherein the item is adapted to connect to the at least two columns.

12. The runner of claim 11 further comprising:

a rib disposed along a lengthwise axis of the runner and positioned between the at least two columns;

a portion of said rib configured as a double wall structure.

13. The runner of claim 12 further comprising:

said rib including another one of said at least one compressed double wall structures on either side of the portion of said rib.

14. The runner of claim 11 wherein at least one of said at least two columns defines a top surface and said compressed double wall structure corresponding to the at least one of said at least two columns extends from the top surface to a bottom surface of the runner wherein the bottom surface is defined by an outer surface of said bottom wall.

15. The runner of claim 11 wherein at least one of the at least two columns includes a top surface and tapered sides, the tapered sides extending outwardly in a downward direction.

16. The runner of claim 11 wherein the inner surface of the bottom wall and the inner surface of the top wall are fused together at said at least one compressed double wall structure.

17. The runner of claim 11 further comprising:

a groove defined in at least one of the at least two columns and extending from the top surface towards said bottom surface.

18. The runner of claim 11 further comprising two double wall sections disposed on either side of the at least two columns such that said top surface protrudes above a second top surface of the two double wall sections.

19. The runner of claim 11 further comprising:

a plurality of protrusions extending from said bottom wall, said plurality of protrusions reducing a friction between said bottom wall and a floor for easy movement of the item.

20. The runner of claim 11 further comprising:

a channel extending from said bottom wall towards said top wall and extending between said at least two columns such that a portion of said at least one compressed double wall structure adjacent to one of the columns is disposed between said channel and the one of the columns.

21. A blow molded runner adapted to attach to a bottom of an item, comprising:

at least two supports each having a top, said at least two supports spaced apart at a distance and each one of said at least two supports adapted to contact the item such that at least part of a weight of the item is supported by said at least two supports;

a compressed double wall structure extending continuously from a base of each of said at least two supports located at a bottom of the blow molded runner to the top of each of said at least two supports wherein said compressed double wall structure is defined by fusion of bottom and top walls.

22. The blow molded runner of claim 21 further comprising:

said at least two supports each defining a perimeter, said compressed double wall structure extending around at least 50% of the perimeter of at least one of said at least two supports.

23. The blow molded runner of claim 22 wherein said compressed double wall structure extends around at least 75% of the perimeter of the at least one of said at least two supports.

24. The blow molded runner of claim 21 wherein said at least two supports include at least four supports.

25. The blow molded runner of claim 21 further comprising said at least two supports entirely formed of said compressed double wall structure.

* * * * *